United States Patent [19]

Bonfiglioli et al.

[11] Patent Number: 4,569,321

[45] Date of Patent: Feb. 11, 1986

[54] CARBURETOR FOR INTERNAL COMBUSTION ENGINES WITH ELECTRONICALLY CONTROLLED ELEMENTS CAPABLE OF MAINTAINING THE IDLING SPEED OF THE ENGINE AT A CONSTANT LEVEL

[75] Inventors: Silverio Bonfiglioli, Zola Predosa; Innocenzo Triolo, Bologna; Giovanni Gardellini, Casalecchio di Reno, all of Italy

[73] Assignee: Weber S.p.A., Turin, Italy

[21] Appl. No.: 684,177

[22] Filed: Dec. 21, 1984

Related U.S. Application Data

[63] Continuation of Ser. No. 464,487, Feb. 7, 1983, abandoned.

[30] Foreign Application Priority Data

Feb. 22, 1982 [IT] Italy ..... 3341 A/82

[51] Int. Cl.[4] ..... F02D 11/10

[52] U.S. Cl. ..... 123/438; 123/339; 123/376

[58] Field of Search ..... 123/438, 376, 339, 340, 123/352, 389, 327, 391

[56] References Cited

U.S. PATENT DOCUMENTS

| | | | |
|---|---|---|---|
| 2,338,912 | 1/1944 | Ericson | 123/376 |
| 2,454,914 | 11/1948 | DeMarco | 123/376 |
| 3,752,141 | 8/1973 | Charron et al. | 123/376 |
| 3,760,785 | 9/1973 | Harrison et al. | 123/376 |
| 3,805,760 | 4/1974 | Yagi et al. | 123/376 |
| 4,022,179 | 5/1977 | Kalert et al. | 123/376 |
| 4,095,567 | 6/1978 | Chenet | 123/339 |
| 4,335,689 | 6/1982 | Abe et al. | 123/340 |
| 4,363,303 | 12/1982 | Takayama | 123/376 |
| 4,487,186 | 12/1984 | Wahl et al. | 123/438 |

*Primary Examiner*—Raymond A. Nelli

*Attorney, Agent, or Firm*—Stevens, Davis, Miller & Mosher

[57] ABSTRACT

A carburetor is provided which has a main barrel in which there is a throttle which turns integrally with a shaft. An idle system opens into the main barrel through three holes; and a lever is splined to the shaft and connected to the accelerator to open the throttle against the action of a spring. Stop devices operate on the lever to define a first position of the throttle for which the holes are upstream. A second lever is idle mounted on the shaft. This second lever uses pushers and operates against the action of a rod positioned by a rotating cam with an electromagnetic element, or electronic gear box to rotate the first lever. This second lever defines, when the accelerator is released, small opening positions of the throttle differing from the first position. A microprocessor gearbox processes the signals expressing the functioning conditions of the engine to operate the electromagnetic element or electronic gear box.

4 Claims, 2 Drawing Figures

CARBURETOR FOR INTERNAL COMBUSTION ENGINES WITH ELECTRONICALLY CONTROLLED ELEMENTS CAPABLE OF MAINTAINING THE IDLING SPEED OF THE ENGINE AT A CONSTANT LEVEL

This application is a continuation, of application Ser. No. 464,487, filed Feb. 7, 1983 now abandoned.

The invention refers to carburetors for internal combustion engines of the type comprising a suction barrel and a throttle.

Currently produced carburetors have devices which determine various small opening positions of the throttle for interrupting the fuel flow when the engine is turned off or when decelerating, and obtaining an accelerated idling speed for starting and for running the engine when cold, for running under the load of an air conditioning system or similar auxiliary equipment and to reduce pollutants. With known types of carburetors, it is not possible to obtain the following functions: maintenance of a particularly low idling speed at a constant level for a relatively extended period of time; or definition of correct or desired accelerated idling speeds when necessary.

The aim of this invention is to remedy the failings of the known techniques by defining a carburetor in which mechanical and electromagnetic elements, controlled by an electronic gearbox and arranged in a single body, define various positions of the throttle when the accelerator is released. The carburetor of the present invention functions to achieve an immediate cut-out of the engine, to optimize the functioning of the engine during deceleration and to determine a correct idling speed, i.e., a correct cold idling speed, and a correct accelerated idling speed.

Figure 1:
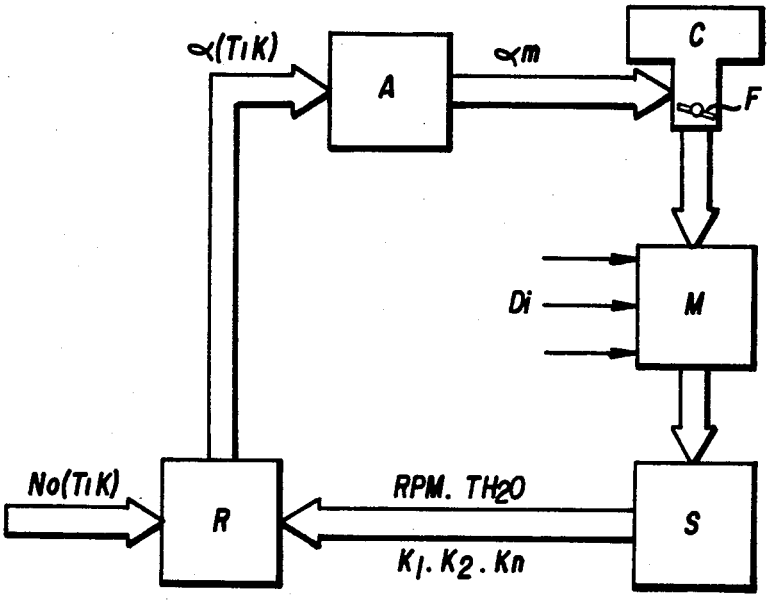
Figure 2:
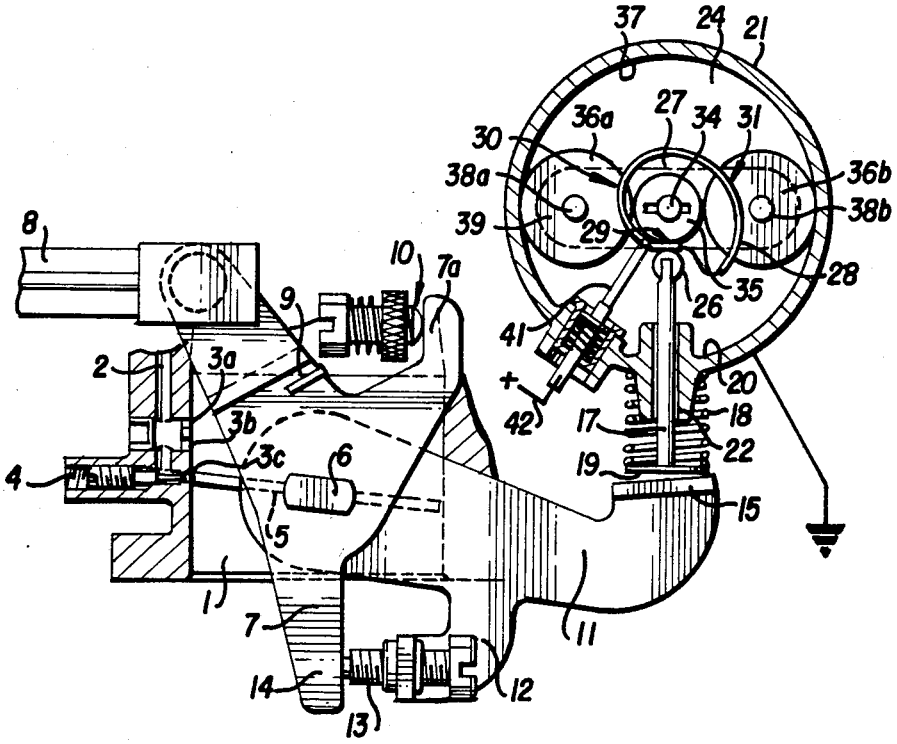

The invention consists of a carburetor characterised by what is stated in the claims; other aims, characteristics and advantages of the invention will be better understood by referring to the enclosed drawings, which illustrate one non-restrictive example or embodiment in which:

FIG. 1 is a block diagram illustrating the control of a carburetor of the type in question; and FIG. 2 shows particular details of a carburetor according to the invention.

The system shown in FIG. 1 comprises a carburetor C, having a throttle F which regulates flow of fuel sucked in by an engine M. The various problems or parameters D which affect the engine, alter the variably controlled RPM from a nominal predetermined RPM value $N_o(T,K)$ and are read by a certain number of sensors S, which detect the speed, the temperature of the cooling water, the load applied to the engine by, for example, an air conditioning system and the idling speed functioning condition.

The outgoing or output signals of the sensors S are sent to a microprocessor electronic gearbox R, which, for each functioning condition of the engine, defines a signal $\alpha_o(T,K)$ for controlling an actuator A. A nominal RPM value $N_o(T,K)$ is constantly compared with the actual RPM value in order to define, by means of the actuator A, the correct speed $\alpha_m$ of the throttle and thereby achieve a correct and lasting idling speed.

FIG. 2 represents a carburetor with a suction barrel 1, an idle system 2 which opens into the barrel 1 by means of three holes 3*a*, 3*b* and 3*c*, the last of which has a delivery section which can be adjusted by means of a taper point screw 4. Throttle 5 turns with a shaft 6, on which a lever 7 is splined. Lever 7 is counterstressed by an accelerator 8 and by a return spring 9. Screw 10 limits the anti-clockwise rotation of the lever 7. Arm 7*a* of the said lever 7 abuts against the screw 10 under pressure of the spring 9; this abutment defines the first position of the throttle 5 whereby the three holes 3*a*, 3*b* and 3*c* are positioned upstream of the throttle 5. A second lever 11, with a lug 12 supporting a screw 13 for recovery of the play between the said levers 7 and 11, is idle mounted on the shaft 6; the point of the screw 13 resting on a bracket 14 integral with the lever 7, turns the said lever 7 in a clockwise direction. The lever 11 has an arm 15 which supports the lower end of a rod 17 pressed downwards by a spring 18 positioned between a ring 19 and a shoulder 20 on the external surface of a casing 21. When the accelerator is released, the rod 17 is pushed upwards by the lever 11. The casing 21 makes up the actuator A of FIG. 1; it consists of: a hub 22, in which a guide hole for the rod is cut; and a cavity 24 which houses part of the rod 17, the upper end of which telescopically supports a roller 26. The cavity 24 houses a metal cam 27, the contour of which has three distinct zones 29, 30 and 31; the zone 29 permits maximum upward movement of the rod 17 without it abutting cam 27; zones 30 and 31 move the rod 17 downwards.

A sliding contact 41 touches the contour 28 of cam 27, to make electrical contact between a rheopore 42 connected to the gearbox R and the earth T by means of the cam 27, the roller 26 and the lever 7. Cam 27 is electrically insulated from the casing 21 by means of an insulating plate, not shown, but positioned between the said elements: the said electrical connection is closed when the rod 17 touches the contour 28.

To position the cam 27, there is a permanent magnet step motor 44 with a shaft 34 which turns a planet wheel carrier 35 which transmits the movement to two planet wheels 36*a* and 36*b* which engage with a crown 37; two shafts 38*a* and 38*b* turn a train carrier 39, the shaft of which is integral with the cam 27.

This epicyclic train makes it possible to connect the step motor to the cam 27 with an appropriate velocity ratio. Developing primarily in a radial direction of the step motor solves the problems of assembling the device on the carburetor; its sturdiness resists the vibrations caused by the engine.

To explain the functioning of the invention, reference is made to the four functioning phases of the engine; in three of these, the accelerator 8 is released, in the last it is depressed. The deceleration phase is identified by the release of the accelerator 8 and by a speed higher than the threshold memorized or stored in the gearbox R and is dependent on the temperature of the engine ($RPM > RPM_1$). During this phase, the step motor receives a number of impulses from the gearbox R which allow it to turn the cam 27 until the roller 26 is facing the zone 29; the position of the throttle 5 under the action of the spring 9 is defined by the locator between the lug or arm 7*a* and the screw 10 so that the holes 3*a*, 3*b* and 3*c* are upstream of the throttle 5. Fuel flow through the circuit 2 is interrupted and the engine sucks in air, increasing the braking effect and reducing consumption and pollutants. As soon as the engine reaches the RPM $RPM_2$ speed, where $RPM_2$ corresponds to another threshold memorized or stored in the gearbox R and dependent on the engine temperature, the gearbox R sends a number of impulses to the step motor, which turn the cam 27 so that it coincides with the rod 17 in the zone 30 to achieve a correct idling speed thus restoring the said electrical connection.

At minimum idling speed, the position of the throttle 5 is determined by the position of the rod 17; if this corresponds to an $RPM > N_o(T,K)$, the gearbox R sends a certain number of impulses to the step motor to turn the cam 27 in a clock wise direction. Rod 17 is pushed upwards by the lever 11 and the contact between the rollers 26 and the zone 30 of the contour 28 is maintained. Clockwise rotation of the cam 27 lasts until the throttle 5, closing under the action of the spring 9, makes it possible to reach the rotation speed $N_o(T,K)$. The same functions, though inverted, occur if the idling speed corresponds to an $RPM < N_o(T,K)$.

During the engine setting up phase of the motor, the gearbox R positions the cam 27 so that the roller 26 coincides with the zone 31 of the contour 28, moving the rod downwards; this corresponds to a greater opening of the throttle 5 which is necessary to obtain an accelerated idling speed. The gearbox R gradually turns the cam 27 to close the throttle 5 which reaches the idle speed position when the roller 26 again coincides with the zone 30.

In this phase, the carburetor functions automatically. The position of the throttle 5 does not depend on the driver's actions; also, its initial positioning and its return to the idling speed position is the result of information received by the gearbox R from a thermosensitive element, in order to define the correct position of the cam 27 corresponding to the nominal value of accelerated idling speed according to the temperature of the engine.

In the acceleration phase, the said electrical circuit opens, thus informing the gearbox R that the driver is operating the throttle 5; the gearbox R causes the cam 27 to remain in the previously reached angular position to prevent malfunctioning of the engine when the accelerator 8 is subsequently released.

We claim:

1. A carburetor for an internal combustion engine for maintaining a low idling speed of said engine at a constant level for a predetermined time period and for providing predetermined levels of accelerated idling speeds as a function of levels of a parameter of said engine, said carburetor comprising:

(a) a carburetor suction barrel having an angularly movable shaft disposed in an intermediate region thereof and a plurality of idle holes through which a fuel/air mixture is delivered into said barrel and thereafter to said engine;

(b) a throttle mounted on said shaft in said barrel such that said throttle moves angularly with said shaft, said throttle being adjustable by means of angular movement of said shaft to occupy a plurality of positions relative to said idle holes;

(c) an idle system for providing said fuel/air mixture to said barrel through said idle holes;

(d) a first lever slidably connected at a first portion thereof to said shaft and rotatably connected at a second portion thereof spaced from said first portion to an accelerator pedal of said engine;

(e) a first spring tending to bias said first lever, said shaft and said throttle toward a first position at which said idle holes are upstream relative to said throttle to cause fuel flow from said idle system to said barrel and said engine to be interrupted, said accelerator pedal and said throttle operating against said bias of said first spring when said accelerator pedal is pushed down;

(f) first stopping means for abutting said first lever to stop movement of said first lever, said shaft and said throttle at said first position against said bias of said first spring;

(g) a second lever rotatably mounted on said shaft, for contacting said first lever to cause said first lever to rotate relative to said accelerator pedal whereby said first lever, said shaft and said throttle are moved to a second position at which fuel flow from said idle system to said engine occurs in amounts sufficient to achieve a range of desired RPM of said engine; and (h) means for causing said second lever to rotate with respect to said shaft, said means comprising:

(i) an elongated member having one end which engages an end of said second lever;

(ii) a cam having a cam contour for engaging another end of said elongated member, said cam being rotatable to move said elongated member to push said end of said second lever to a plurality of distinct positions whereby said second lever causes said first lever to rotate as in (f) above;

(iii) a step motor; and (iv) epicyclic train means responsive to rotation of a motor shaft of said step motor for rotating said cam to a plurality of angular positions such that said cam positions said elongated member in said plurality of distinct positions.

2. The carburetor as in claim 1, wherein said cam contour comprises a first zone which permits maximum movement of said elongated member in a direction toward said cam contour without allowing contact between said cam contour and said elongated member whereby said first position of said throttle is achieved.

3. The carburetor as in claim 2, further comprising microprocessor means receiving a signal representing a particular said parameter level of said engine for providing an output signal to said idling means, said output signal indicating a predetermined RPM level appropriate for said engine based on said particular parameter level of said engine, and wherein a sliding contact touches the contour of said cam to provide an electrical signal to said microprocessor means to signal release of said accelerator pedal and a second spring tends to bias said elongated member away from said contour of said cam when the accelerator pedal is released.

4. The carburetor as in claim 2, wherein said cam has a contour comprising a second zone and a third zone, each for moving said elongated member in a direction away from said cam.

* * * * *